US011925276B2

(12) United States Patent
Peaple

(10) Patent No.: US 11,925,276 B2
(45) Date of Patent: Mar. 12, 2024

(54) EXPANDABLE DISPLAY FRAME

(71) Applicant: Stephen Peaple, Claremont (AU)

(72) Inventor: Stephen Peaple, Claremont (AU)

( * ) Notice: Subject to any disclaimer, the term of this patent is extended or adjusted under 35 U.S.C. 154(b) by 0 days.

(21) Appl. No.: 17/893,475

(22) Filed: Aug. 23, 2022

(65) Prior Publication Data

US 2023/0055111 A1 Feb. 23, 2023

(30) Foreign Application Priority Data

Aug. 23, 2021 (AU) ..... 2021106607

(51) Int. Cl.

| | |
|---|---|
| ***A47F 5/00*** | (2006.01) |
| ***A47F 5/08*** | (2006.01) |
| ***A47F 7/00*** | (2006.01) |
| ***A47F 7/14*** | (2006.01) |
| ***A47G 1/06*** | (2006.01) |
| ***A63H 3/50*** | (2006.01) |

(52) U.S. Cl.

CPC ..... *A47F 5/0025* (2013.01); *A47F 5/0846* (2013.01); *A47F 7/144* (2013.01); *A47G 1/0622* (2013.01); *A63H 3/50* (2013.01); *A47F 2007/0092* (2013.01)

(58) Field of Classification Search

CPC .. G09F 15/0068; A47F 5/0025; A47F 5/0846; A47F 3/001; A47F 5/10; A47F 5/132; A47F 2007/0092; A47F 7/142; A47F 7/14; A47F 7/144; A47F 7/146; A47F 7/147; A47F 5/16; A47G 1/0622; A47G 33/004; A47G 1/12; A47G 1/08; A63H 3/50; F16B 12/10; F16B 12/125; F16B 12/126; A47B 47/0016

USPC ..... 211/88.01, 182; 40/730, 735, 781, 732, 40/783, 800, 772, 716, 737, 739, 741, 40/743

See application file for complete search history.

(56) References Cited

U.S. PATENT DOCUMENTS

| | | | | | |
|---|---|---|---|---|---|
| 118,380 | A * | 8/1871 | Monroe | A47F 7/02 | 40/792 |
| 2,593,195 | A * | 4/1952 | Rosenberg | A47G 1/065 | 40/792 |
| 3,715,136 | A * | 2/1973 | Yoshida | F16B 2/14 | 217/65 |
| 3,771,244 | A * | 11/1973 | Ebner | A47G 1/06 | 40/721 |
| 3,913,289 | A * | 10/1975 | Recker | E04B 1/1903 | 211/188 |
| 3,957,157 | A * | 5/1976 | Therrien | A47G 1/12 | 206/0.83 |
| 4,145,827 | A * | 3/1979 | Katsufrakis | A47G 1/065 | 40/729 |

(Continued)

*Primary Examiner* — Jennifer E. Novosad

(74) *Attorney, Agent, or Firm* — PETE ADAMS LAW, PLLC

(57) ABSTRACT

A display frame comprises exterior shelf units. The frame has interior shelf units which slidably and directly engage with each other and the exterior shelf units. The frame also comprises exterior connectors for connecting the exterior shelf units and the interior connectors. The interior connectors are hash shaped and oriented at an angle with respect to the vertical plane of the display frame and the sliding together of the exterior shelf units with the hash shaped connectors are used to expand display shelf frame. The exterior shelf units and the interior shelf units are slideably engaged with each other.

1 Claim, 8 Drawing Sheets

(56) References Cited

U.S. PATENT DOCUMENTS 4,277,904 A * 7/1981 Leuthesser ..... G09F 13/04 40/716
4,290,530 A * 9/1981 Wooster ..... A47F 7/146 211/186
4,493,425 A * 1/1985 Yoshida ..... A47B 47/0033 211/186
4,553,344 A * 11/1985 Rubin ..... A47G 1/142 40/792
4,585,131 A * 4/1986 Crossman ..... A47B 96/1475 D25/123
4,819,814 A * 4/1989 Fogelgren ..... A47F 7/146 312/107
4,955,485 A * 9/1990 Alton ..... A47G 1/12 211/188
5,054,668 A * 10/1991 Ricchiuti ..... B60R 7/02 224/311
5,105,567 A * 4/1992 Real ..... G09F 7/10 40/776
5,172,817 A * 12/1992 Gross ..... G11B 33/0483 211/40
5,259,517 A * 11/1993 Pancoe ..... A47F 5/0846 211/163
5,265,360 A * 11/1993 Reiss ..... A47G 1/0616 362/125
5,477,594 A * 12/1995 LePage ..... E04H 13/006 211/84
5,485,926 A * 1/1996 Kundert ..... G11B 33/0483 312/9.9
5,713,475 A * 2/1998 Wang ..... G09F 7/22 211/163
5,715,956 A * 2/1998 Yoshida ..... A47B 96/06 211/186
5,733,166 A * 3/1998 Hoag ..... A63H 3/50 446/26
5,803,782 A * 9/1998 Selton ..... A47B 47/005 446/125
5,826,729 A * 10/1998 Oosterom ..... A47B 81/068 211/90.04
5,857,578 A * 1/1999 Fishman ..... A47F 5/0846 211/189
5,899,012 A * 5/1999 Crum ..... G09F 13/04 40/716
6,010,015 A * 1/2000 Lin ..... G11B 33/0472 211/186
6,012,245 A * 1/2000 Squitieri ..... G11B 33/0483
6,315,375 B1 * 11/2001 Reeves ..... A47F 7/0028 312/139.2
6,349,494 B1 * 2/2002 Haggarty-Robbins ... G09F 1/12 40/792
6,385,886 B1 * 5/2002 Chepikian ..... A47G 1/14 40/729
6,490,818 B1 * 12/2002 Bramhall ..... A47G 1/065 116/323
6,532,878 B2 * 3/2003 Tidemann ..... A47B 47/042 108/186
6,595,378 B2 * 7/2003 Wang ..... A47B 47/0075 211/186
6,845,871 B1 * 1/2005 Culp ..... A47B 47/042 211/186
7,055,275 B1 * 6/2006 Teza ..... G09F 1/12 40/739
7,117,998 B2 * 10/2006 Krapf ..... G09F 15/00 40/124.05
7,146,760 B2 * 12/2006 Yiu ..... A47F 3/001 40/714
7,237,683 B1 * 7/2007 Hammers ..... A47G 1/12 248/688
7,266,920 B2 * 9/2007 Kao ..... A47G 1/12 40/781
7,418,796 B2 * 9/2008 Anastasio ..... A47G 1/065 40/772
7,437,846 B2 * 10/2008 Franco ..... A47G 1/12 40/729
7,481,014 B2 * 1/2009 Milburn ..... A47B 46/005 40/724
7,604,133 B2 * 10/2009 Tsai ..... A47B 73/006 211/189
7,963,404 B2 * 6/2011 Shang ..... A47F 7/08 211/36
8,042,294 B2 * 10/2011 Snider ..... B42D 3/18 40/711
8,302,339 B2 * 11/2012 Pender ..... G09F 23/00 211/24
8,458,980 B2 * 6/2013 Ivanov ..... A63H 33/084 446/105
8,464,450 B1 * 6/2013 Kendall ..... A47G 1/12 40/737
8,595,969 B1 * 12/2013 Wheelis ..... A47G 1/12 206/778
8,662,326 B2 * 3/2014 Brick ..... A47B 47/042 211/186
8,984,785 B2 * 3/2015 Kang ..... G09F 19/12 40/737
9,032,654 B2 * 5/2015 Wilcoxen ..... A63F 1/02 40/766
9,089,212 B2 * 7/2015 Chang ..... A47B 47/0016
9,226,576 B2 * 1/2016 Shang ..... A47B 47/0033
9,370,243 B2 * 6/2016 Menard ..... A47B 47/0091
10,172,484 B2 * 1/2019 Maldonado ..... A47F 7/06
10,912,399 B2 * 2/2021 Cianchino ..... A47F 3/004
11,452,372 B2 * 9/2022 Wei ..... A47F 3/147
2002/0000058 A1 * 1/2002 Chang ..... G09F 19/12 40/738
2002/0066218 A1 * 6/2002 Darby ..... G09F 15/0018 40/792
2003/0033745 A1 * 2/2003 Ribaudo ..... B44C 5/005 40/800
2005/0098510 A1 * 5/2005 Lom ..... A47F 7/147 211/13.1
2005/0172532 A1 * 8/2005 Yiu ..... A47F 3/001 40/714
2006/0189247 A1 * 8/2006 Matheus ..... A47F 3/004 446/75
2006/0207957 A1 * 9/2006 Chen ..... A47B 47/0066 211/183
2007/0289180 A1 * 12/2007 Johnson ..... G09F 13/18 40/546
2009/0039742 A1 * 2/2009 Ripley, Jr. ..... A47F 3/004 312/114
2009/0119964 A1 * 5/2009 Snider ..... B42D 1/08 40/745
2009/0309464 A1 * 12/2009 Schwartz ..... A47B 47/042 312/107
2012/0009010 A1 * 1/2012 Wu ..... F16B 7/048 403/217
2012/0255923 A1 * 10/2012 Johnson ..... A47B 57/10 211/88.01
2013/0031818 A1 * 2/2013 Kim ..... A47G 1/065 40/735
2015/0076099 A1 * 3/2015 Chang ..... A47F 5/132 211/186
2016/0066688 A1 * 3/2016 Yu ..... A47B 47/0075 312/265.5
2017/0232354 A1 * 8/2017 Arboleda ..... A63H 3/50 446/71
2019/0321738 A1 * 10/2019 Chambers ..... A63H 3/00
2020/0315330 A1 * 10/2020 Williams ..... A45F 5/00
2022/0061521 A1 * 3/2022 Schwartz ..... A47B 97/00
2022/0386791 A1 * 12/2022 Kemp ..... A47F 5/08
2023/0055111 A1 * 2/2023 Peaple ..... A47B 47/042
2023/0086056 A1 * 3/2023 Williams ..... A63H 3/50 24/116 R

* cited by examiner

EXPANDABLE DISPLAY FRAME

BACKGROUND OF THE INVENTION

1. Field of the Invention

The present invention relates to the furniture industry and, more particularly to a frame which is well adapted for displaying miniature figurines.

2. Description of Related Art

Plastic construction toys are manufactured by The Lego Group, among other companies. These toys comprise interlocking plastic bricks and also miniature figurines adapted to interface with the studs on the plastic Lego bricks. Many Lego enthusiasts like to have display stands for their miniature figurines.

However, there currently is no aesthetically pleasing versatile plastic display frame for miniature figurines which have: (1) integral studs for holding the miniature figurines, (2) which are expandable to any custom size and (3) which can also be readily flat packed for postage.

If the display stand is not able to be flat packed, then it would not be economically feasible for it to be posted to customers. That is, the stand would take up too much volume, which would increase the costs of postage to an unprofitable level.

If the display stand is not expandable, the user could not expand the stand to accommodate their growing collection of items for display.

The object of the present invention is to provide an aesthetically pleasing, versatile, plastic display frame which is expandable to any custom size and which can also be readily flat packed for postage.

SUMMARY OF THE INVENTION

According to the present invention, there is provided a display frame comprising:

(a) exterior shelf units;

(b) interior shelf units which slidably and directly engage with each other and the exterior shelf units;

(c) exterior connectors for connecting the exterior shelf units; and (d) interior connectors;

wherein the interior connectors include hash shaped connectors oriented at an angle with respect to the vertical plane of the display frame and the sliding together of the exterior shelf units with the hash shaped connectors are used to expand the display frame.

Preferably, the exterior shelf units and the interior shelf units are slideably engaged with each other. The interior connectors preferably include center piece connectors and linking connectors.

The exterior shelf units may have lamps to illuminate a transparent back panel. Preferably, the transparent back panel has etching to direct the light from the lamps.

The frame may include a dust cover which is magnetically connectable to the frame.

The interior shelf units preferably have studs for engaging with miniature figurines.

BRIEF DESCRIPTION OF THE DRAWINGS

Embodiments of the invention will be described with reference to the following drawings, in which.

DETAILED DESCRIPTION OF THE INVENTION

Figure 1:
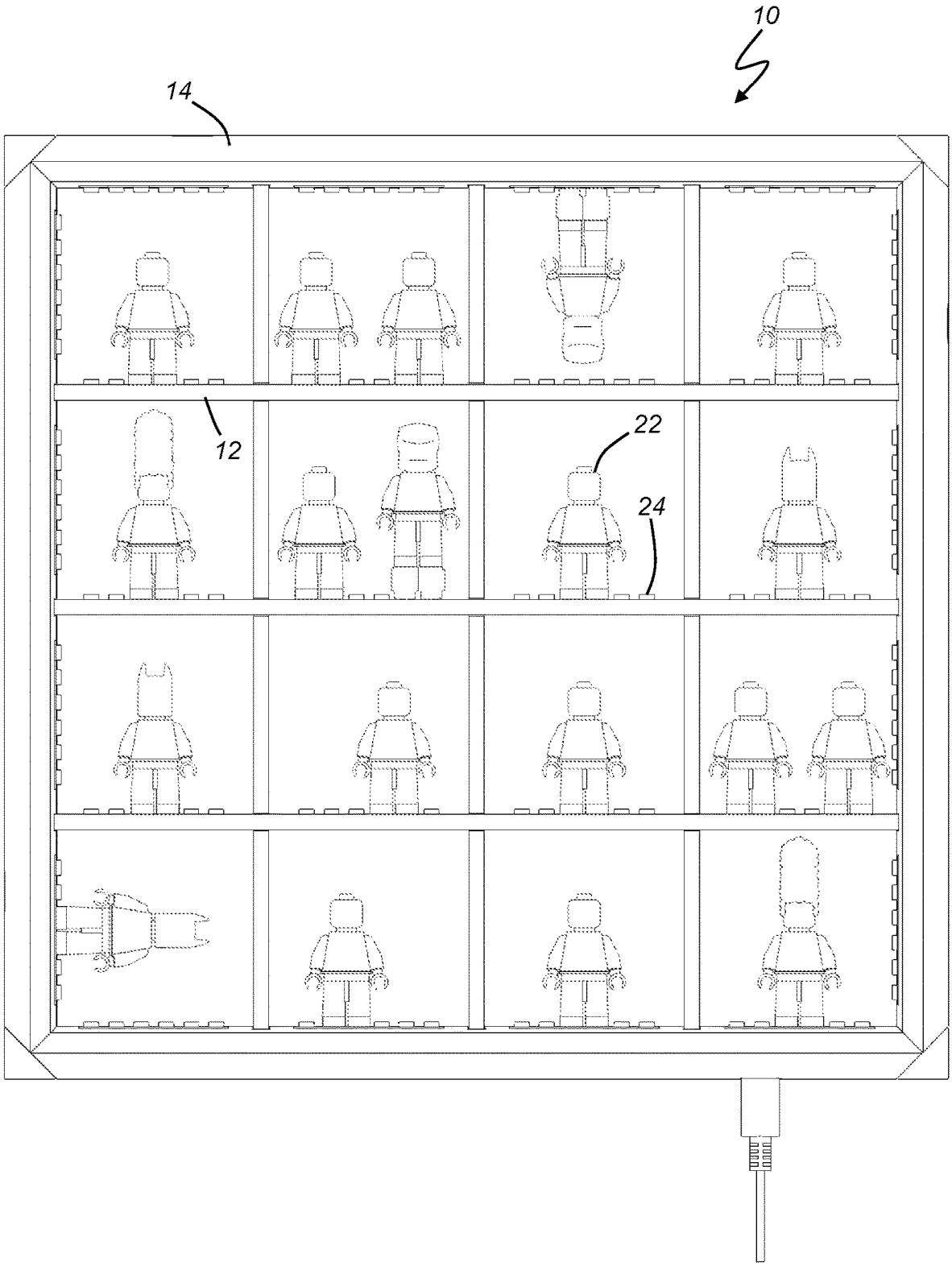
FIG. 1 is a front view of a frame according to an embodiment of the present invention.

FIG. 1 shows the rear side of a display frame 10 according to an embodiment of the present invention.

Figure 2:
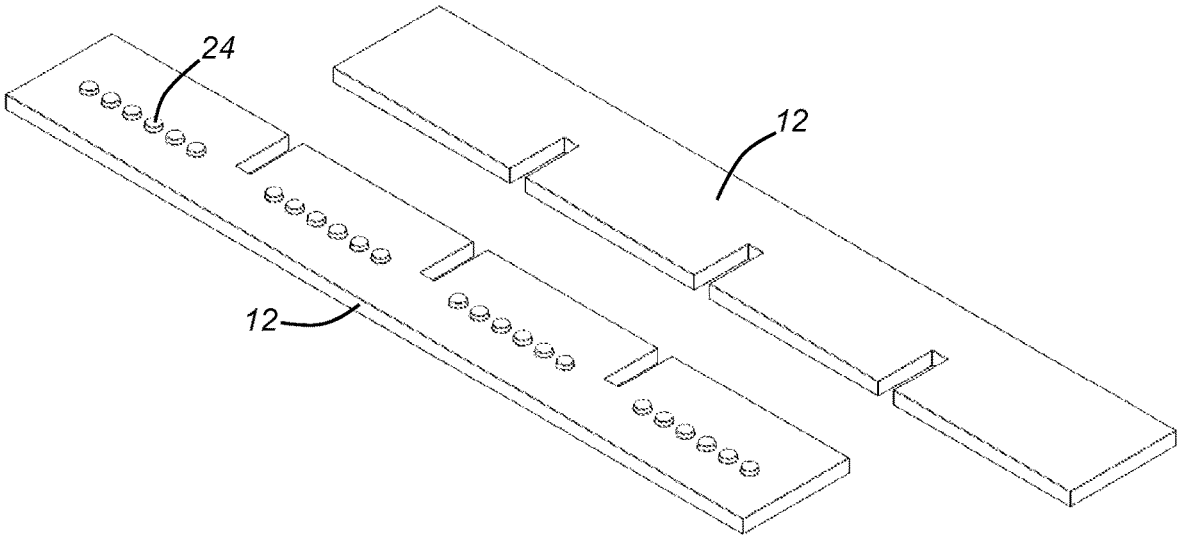
FIG. 2 is a perspective view of the front and back of an interior shelf of the frame of FIG. 1.
Figure 3:
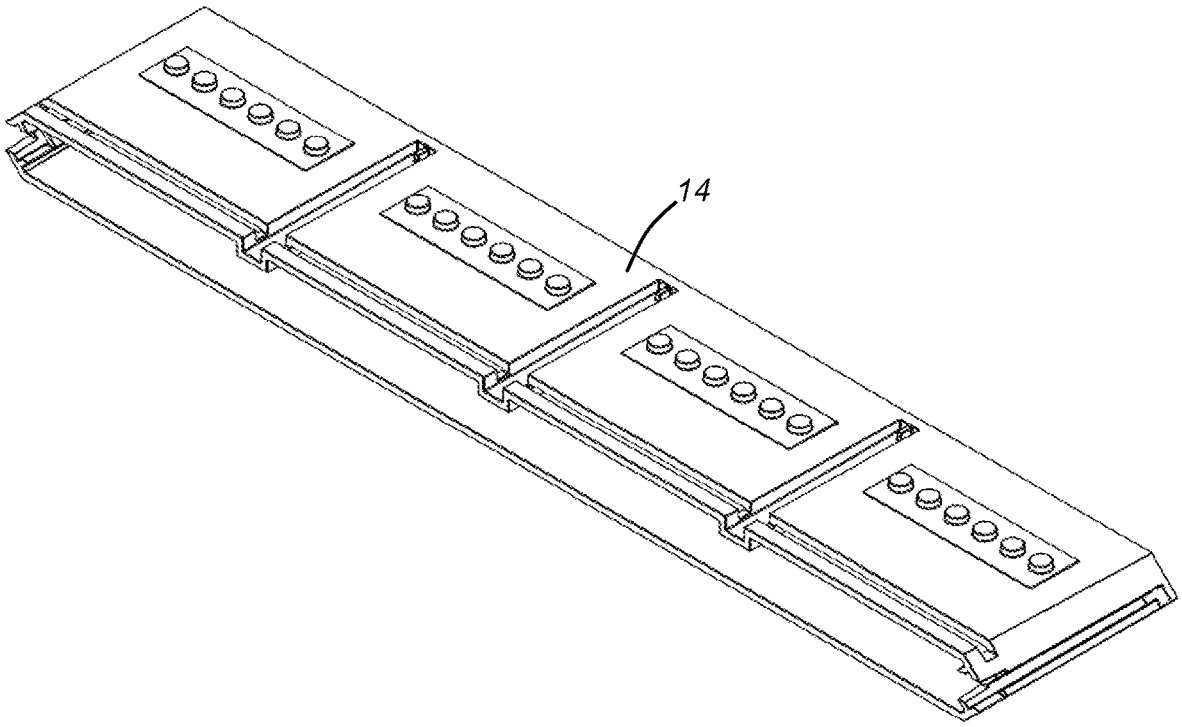
FIG. 3 is a perspective view of an exterior shelf of the frame of FIG. 1.

The frame has interior shelf units 12 (shown in isolation in FIG. 2) and exterior shelf units 14 (shown in isolation in FIG. 3) which are all slidably engageable with each other.

Figure 4:
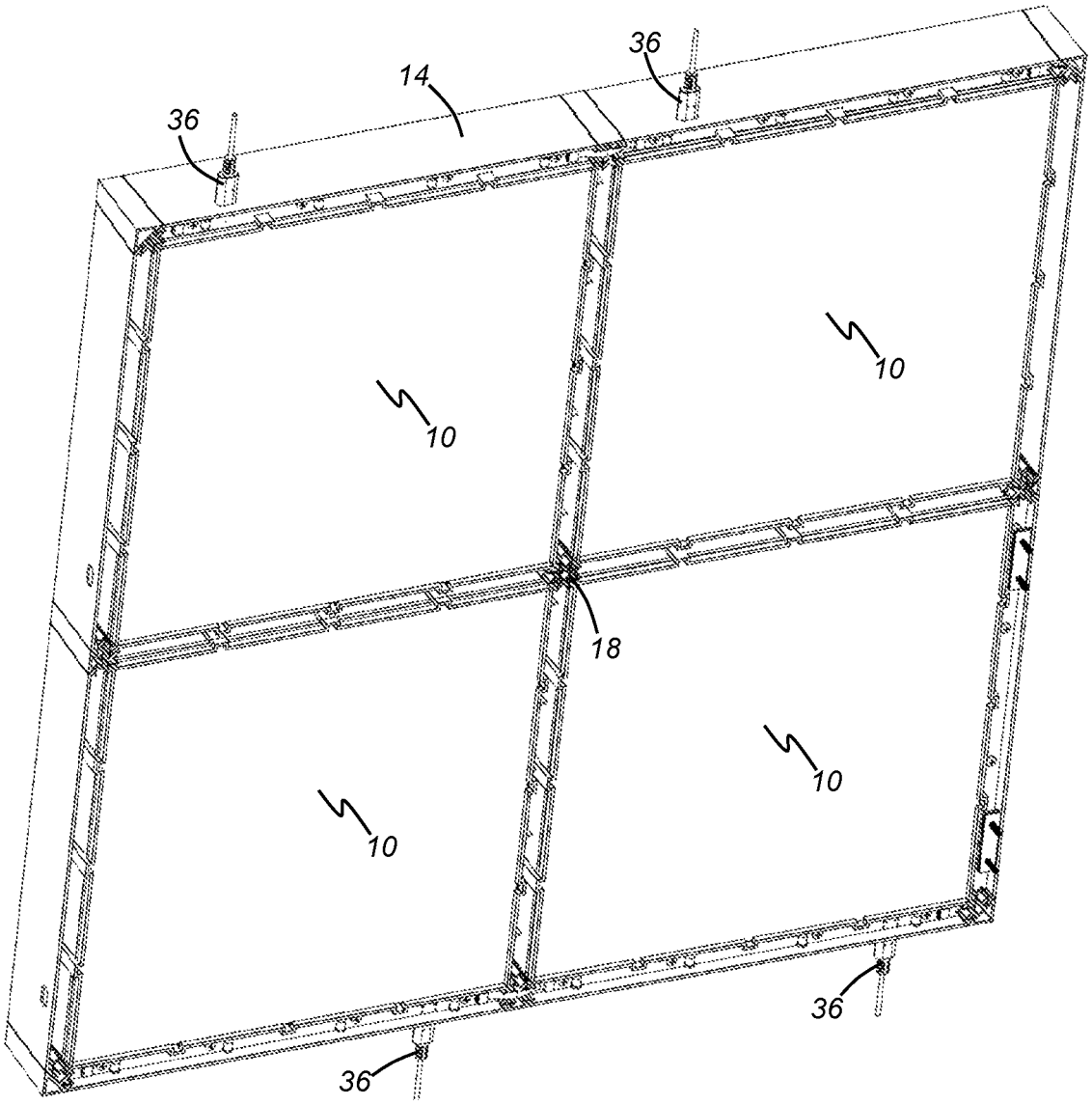
FIG. 4 is rear view of four frames of FIG. 1 conjoined together.

Multiple frames 10 can be conjoined together to expand the shelf space, as shown in FIG. 4.

Figure 7:
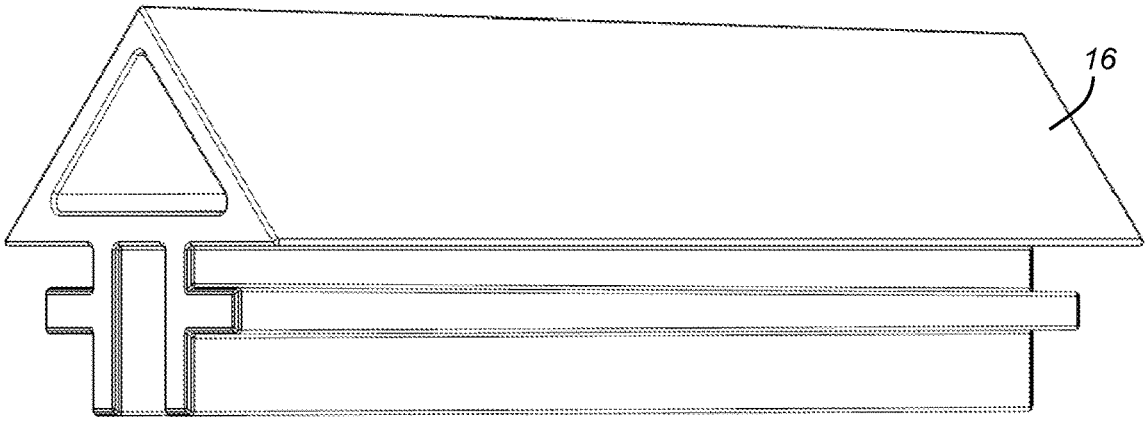
FIG. 7 is a perspective view of a first end of an exterior connector for the frame of FIG. 1.
Figure 8:
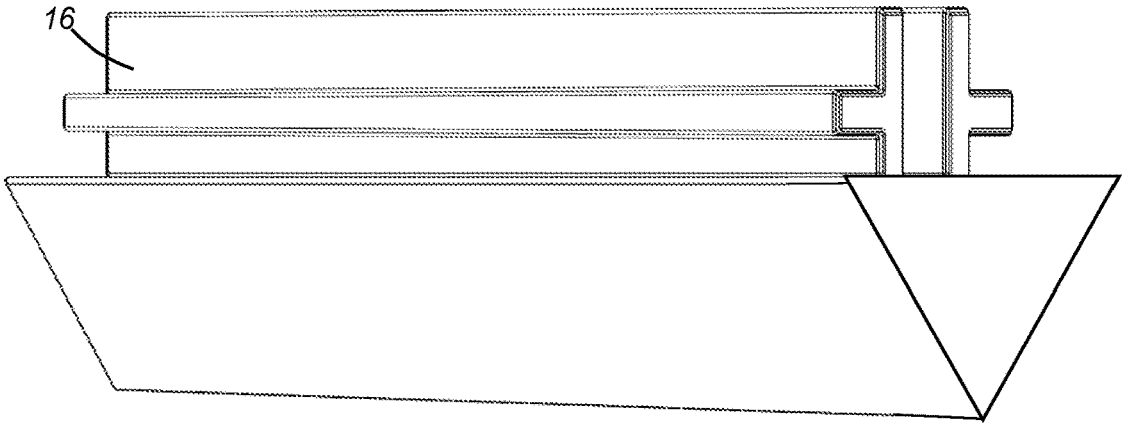
FIG. 8 is a perspective view of a second end of the exterior connector of FIG. 7.
Figure 9:
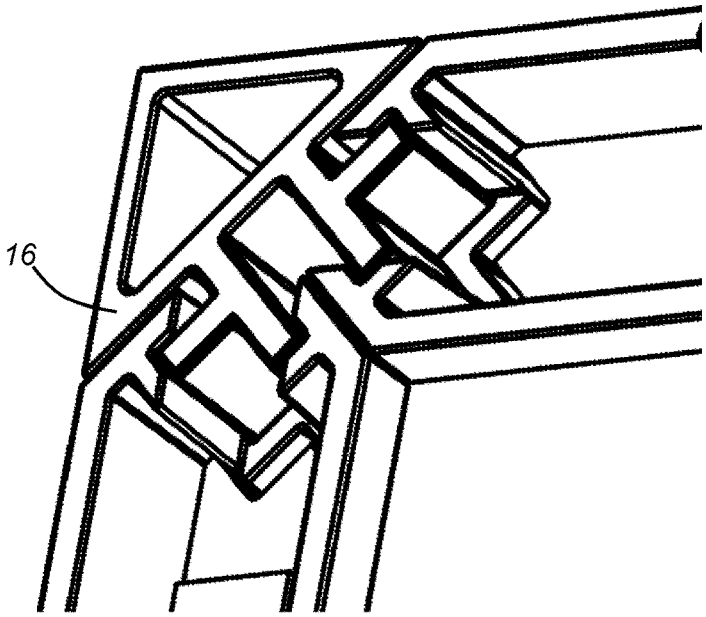
FIG. 9 is a perspective view of the exterior connector of FIGS. 7 and 8 in position within the frame of FIG. 1.
Figure 10:
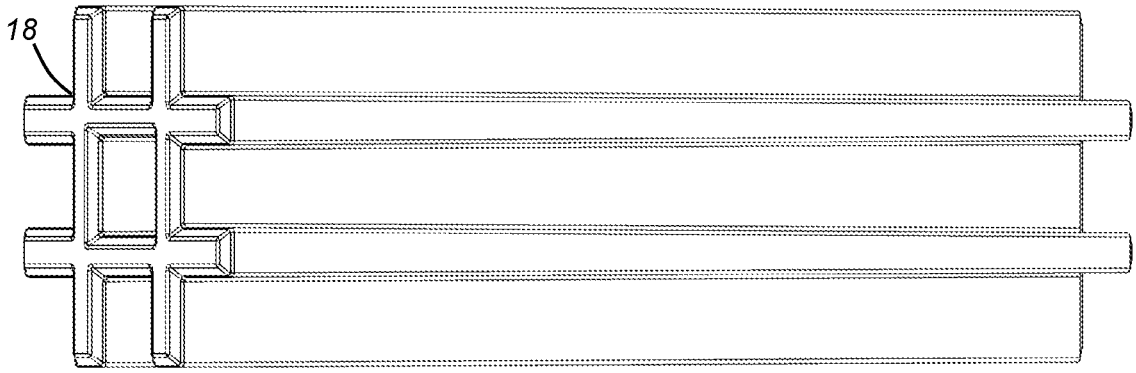
FIG. 10 is a perspective view of an interior hash shaped connector for conjoining frames as shown in FIG. 2.
Figure 11:
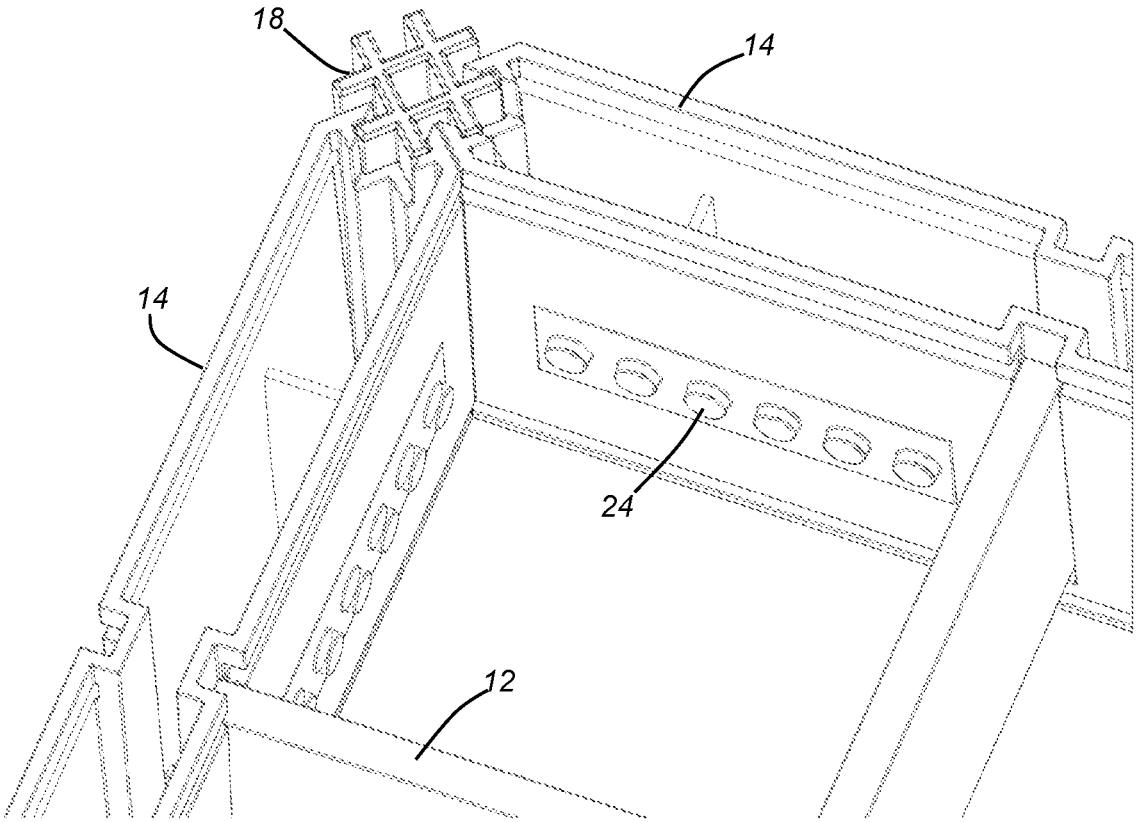
FIG. 11 is a perspective view of the interior hash shaped connector of FIG. 5 in position within the frame.
Figure 12:
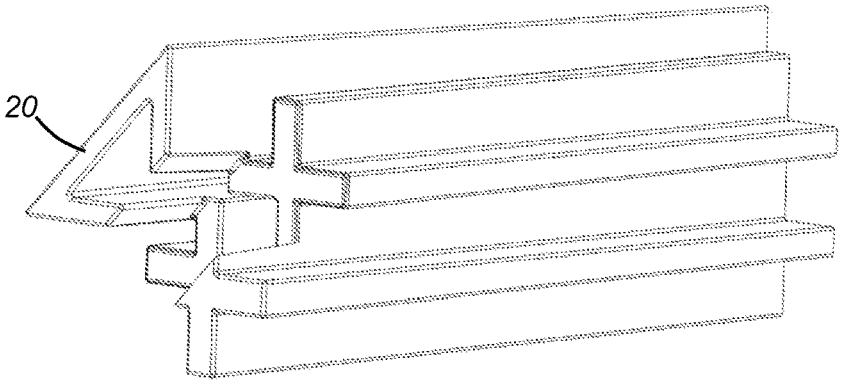
FIG. 12 is a perspective view of a first end of a linking connector for the conjoined frame of FIG. 2.
Figure 13:
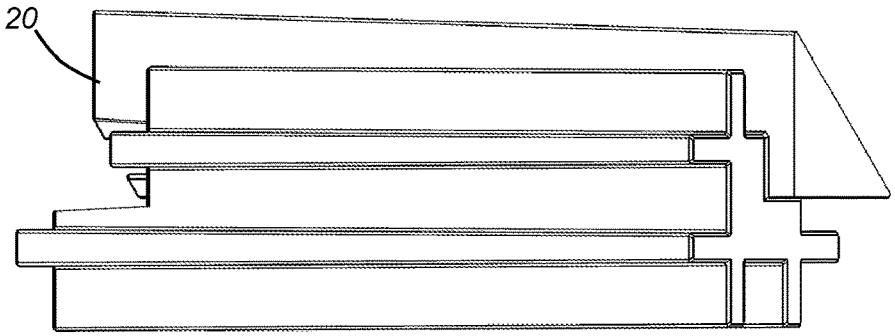
FIG. 13 is a perspective view of a second end of the linking connector of FIG. 10.
Figure 14:
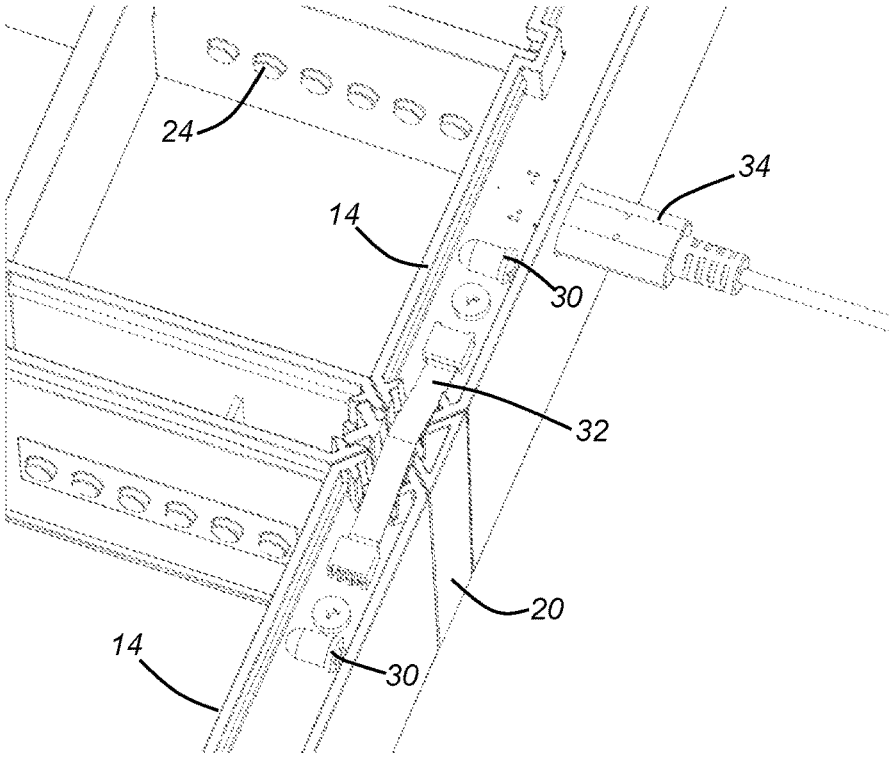
FIG. 14 is perspective view of the linking connector of FIGS. 10 and 11 in position within the frame of FIG. 2, showing the light ribbon connection through a channel in the linking connector

The frames 10 comprise exterior connectors 16 (see FIGS. 7, 8 and 9) and two types of interior connectors, namely the hash shaped connectors 18 (see FIGS. 10 and 11) and linking connectors 20 (see FIGS. 12, 13 and 14).

If the user wants to join multiple frames together (as shown in FIG. 4) then they can replace an exterior connector 16 with a hash shaped connector 18 to slidably engage another exterior shelf unit 14. Thereby, the display frame 10 of the present invention is expandable, unlike prior art display frames. This makes a substantial contribution to the working of the invention.

The frame 10 can be used for displaying Lego brand miniature figurines 22 (see FIG. 1). Hence the interior shelf units have studs 24 for interfacing with holes in the feet of the miniature figurines 22.

Figure 5:
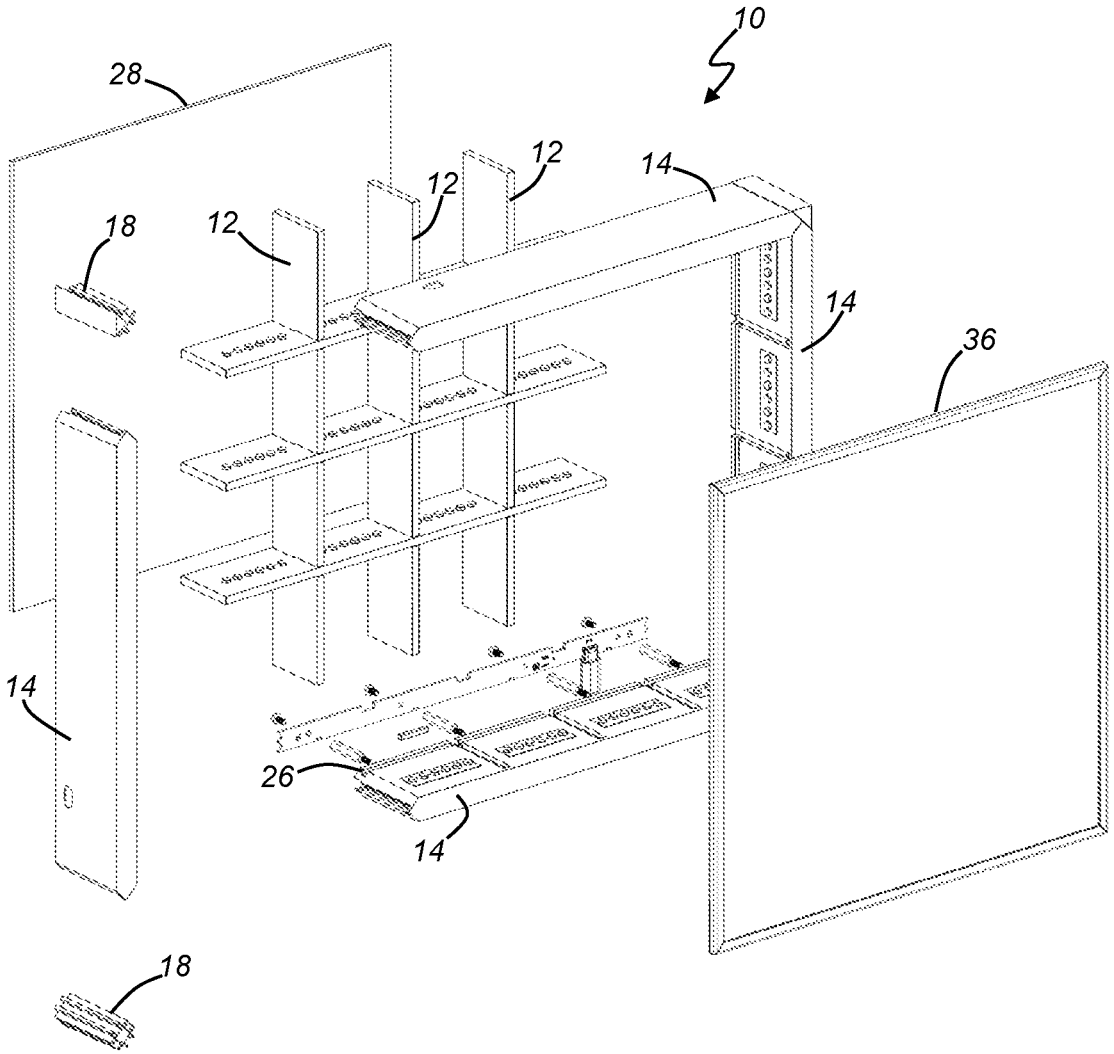
FIG. 5 is an exploded view of a frame according to an embodiment of the present invention.
Figure 6:
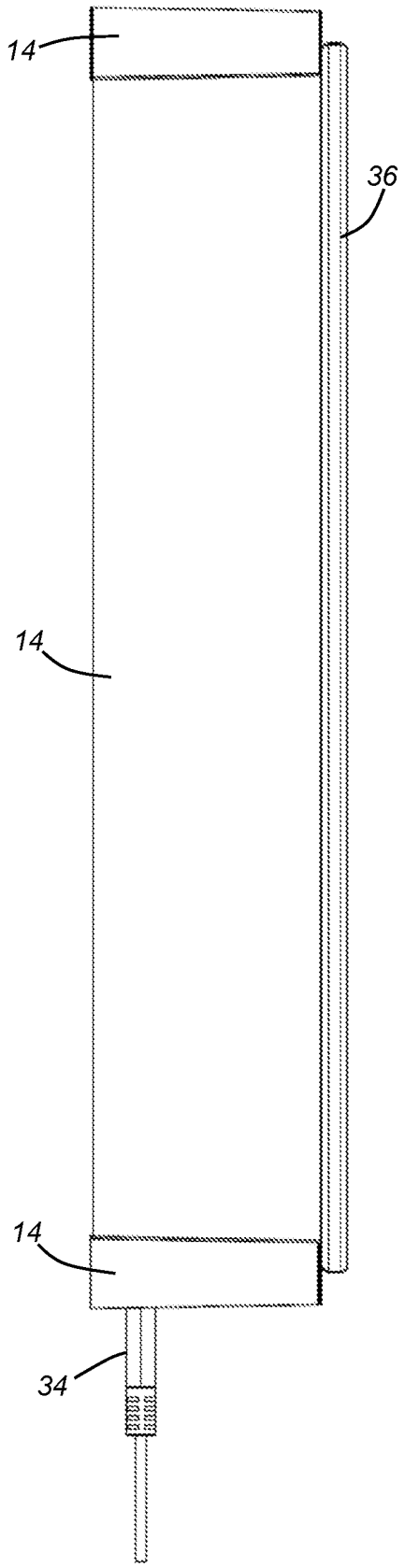
FIG. 6 is a side view of the frame of FIG. 1.

Referring to FIG. 5, the base exterior shelf unit 14 has a slot 26 for a transparent backing panel 28. The base exterior shelf unit 18 has lamps 30 spaced regularly along it. The lamps 30 shine through the transparent backing panel 28 to provide an aesthetically pleasing aspect to the display frame 10. The transparent backing panel 28 can have etching to direct the light through the panel 28 in any particular way. For example, the etching could be an outline of a miniature figurine. As shown in FIG. 14, connectable lighting ribbons 32 bridge over the linking connectors 20 adjoining the exterior shelf units 14. The lighting ribbons 32 provide power to the lamps 30 via a USB-C input cable 34.

As shown in FIG. 5, the frame 10 has a cover 36 which is magnetically connectable to the frame 10.

The present invention thereby provides an aesthetically pleasing, versatile, plastic display frame which is expandable to any custom size, and which can also be readily flat packed for postage.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A display frame comprising:

(a) exterior shelf units;

(b) interior shelf units which slidably and directly engage with each other and the exterior shelf units for supporting and displaying items on or between the interior shelf units, wherein the interior shelf units include studs for engaging with miniature figures;

(c) exterior connectors for interconnecting the exterior shelf units to each other; and (d) interior connectors;

wherein the interior connectors include hash shaped connectors oriented at an angle with respect to a frame width and a frame height of the display frame and the exterior shelf units are joined together with the hash shaped connectors by sliding so that the frame width or frame height of the display frame can be expanded.

* * * * *